US007087827B2

(12) United States Patent
Liao

(10) Patent No.: US 7,087,827 B2
(45) Date of Patent: Aug. 8, 2006

(54) SNARE DRUM STAND LOCK ADJUSTMENT

(76) Inventor: Chi-Ching Liao, c/o PMB#1008, 1867 Ygnacio Valley Rd., Walnut Creek, CA (US) 94598

( * ) Notice: Subject to any disclaimer, the term of this patent is extended or adjusted under 35 U.S.C. 154(b) by 0 days.

(21) Appl. No.: 11/020,360

(22) Filed: Dec. 27, 2004

(65) Prior Publication Data

US 2006/0137507 A1 Jun. 29, 2006

(51) Int. Cl.
*G10D 13/02* (2006.01)

(52) U.S. Cl. ..... 84/421; 84/327

(58) Field of Classification Search ..... 84/421, 84/327; 248/443; D17/99
See application file for complete search history.

(56) References Cited

U.S. PATENT DOCUMENTS 6,259,011 B1 * 7/2001 Liao ..... 84/421
6,344,605 B1 * 2/2002 Liao ..... 84/421

* cited by examiner

*Primary Examiner*—Kimberly Lockett
(74) *Attorney, Agent, or Firm*—Leong C. Lei

(57) ABSTRACT

A snare drum stand lock adjustment comprised of two plates containing an inner channel to merely clamp a lever of a connector; both plates being pivoted to each other on one side with an axial pin; one end of the lock adjustment being fastened to a brace of the stand and the other end receiving insertion of a lever from a connector to permit easy and secure operation of the lock adjustment.

1 Claim, 5 Drawing Sheets

SNARE DRUM STAND LOCK ADJUSTMENT

BACKGROUND OF THE INVENTION (a) Technical Field of the Invention

The present invention is related to a lock adjustment of a snare drum stand, and more particularly, to one has the lever from a connector clamped by two plates pivoted to each other then fastened on the end to the brace of the stand.

(b) Description of the Prior Art

Musical instruments are usually assembled with multiple accessories interlocked to one another. Bolts or nuts and locking plates are used for the assembly purpose. As illustrated in FIGS. 4, 5, and 6 of the accompanying drawings, a snare drum stand has a tube (30) as the primary support adapted with a lever (31) locked to a brace (32) at the top of the stand. Wherein, the level (31) is related to a polygonal provided in a given direction and a lock adjustment (33) is provided to connect the lever (31) and the stand. One end of the lock adjustment (33) is inserted with a shaft (34) that holds the brace (32) while the other end extending outwardly at a right angle to the shaft (34) to receive insertion of the lever (31) and fastened with two locking bolts (35) for the brace (32) to firmly support a snare drum (20).

One end of the lock adjustment is related to a ring for receiving the insertion of the shaft (34) of the brace (32) made in a form of a triangle. The expansion of the brace (32) is adjustable depending on the diameter of the snare drum (20) for the tops of the brace to finnly support the snare drum (20). The other end of the lock adjustment (33) extends vertically to the shaft (34) a hollow section for a proper length to receive insertion by the lever (31). Naturally, the inner surface of the section is made in a form to compromise the appearance of the lever (31) so that once the lever (31) is inserted into the section it will be secured in place. Usually, hexagonal is preferred for the vertically extended section. One or two locking bolt (31) is provided to secure the lever (31) in position. However, the locking hole or holes for the bolt (35) provided on the section must be precisely located, or fails a secured fastening. Furthermore, as the bolt (35) directly contacts the surface of the lever (31), it could easily damage the lever (31), i.e., a dented or roughened surface of the lever (31). In serious case, when the fastening point happens to fall on an edge of the lever (31), it may well get loosened up and prevent easy removal to frustrate a smoother assembly of the lock adjustment. If the surface of the lever (31) becomes dented or uneven, it prevents stable assembly in the subsequent use of the brace (32).

SUMMARY OF THE INVENTION

The primary purpose of the present invention is to provide an improved construction of a lock adjustment of a snare drum stand to ensure of an easy and stable locking of the stand. To achieve the purpose, the lock adjustment is comprised of two plates to clamp a lever from a connector for the stand to firmly support the snare drum.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
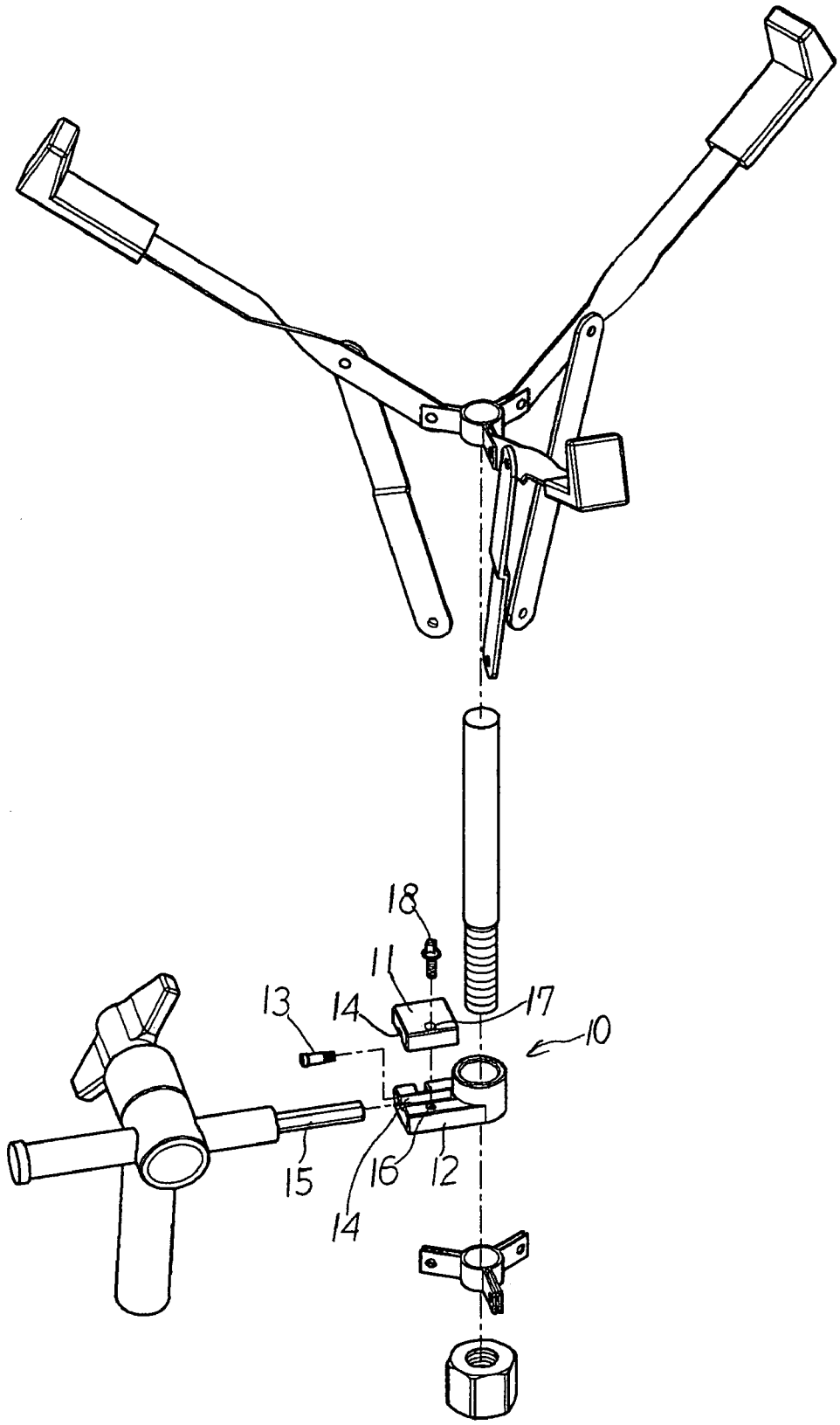
FIG. 1 is an exploded view of a preferred embodiment of the present invention.
Figure 2:
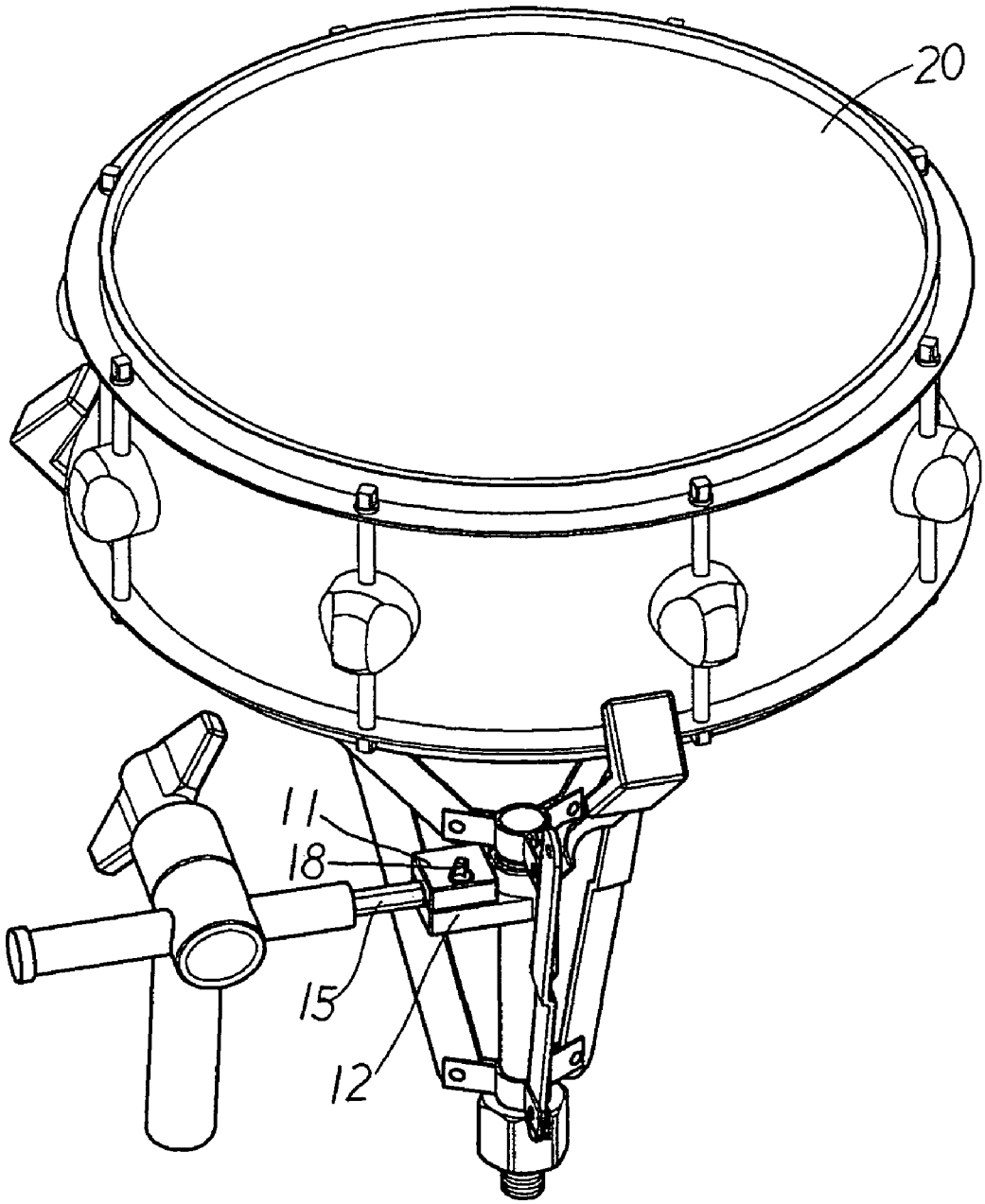
FIG. 2 is a schematic view showing the preferred embodiment of the present invention as assembled.
Figure 6:
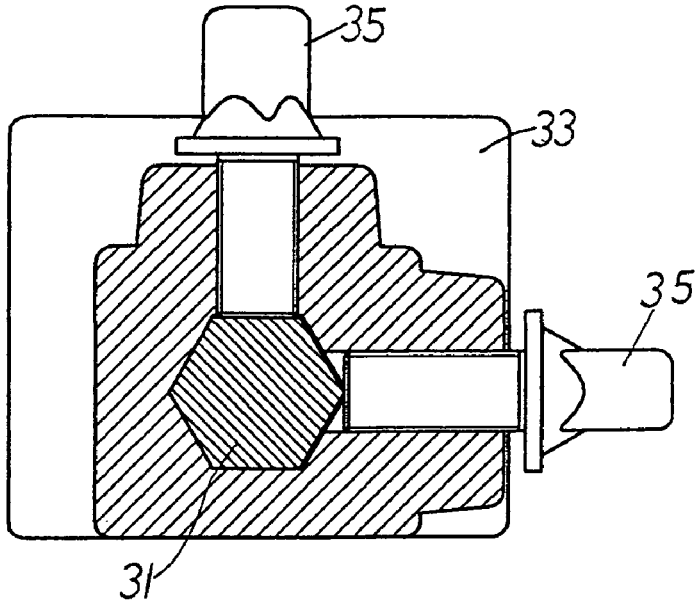
PRIOR ART FIG. 6
FIG. 6 is a sectional view of the prior art.
Figure 3:
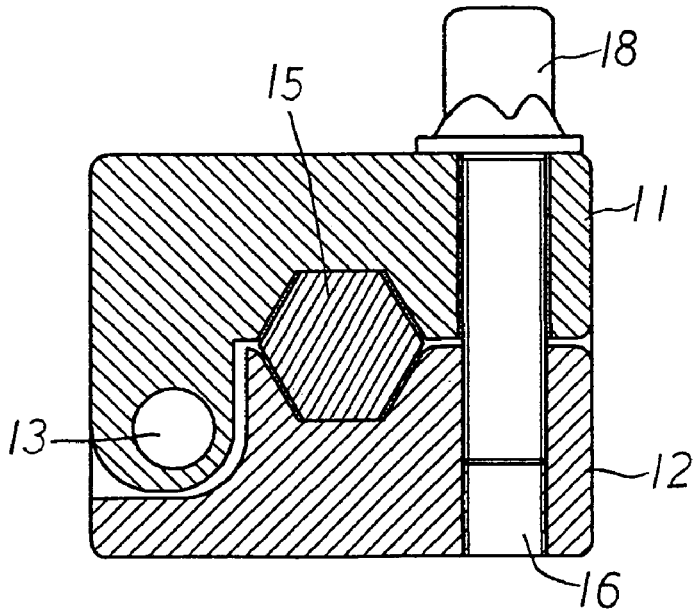
FIG. 3 is a sectional view of the preferred embodiment of the present invention.
Figure 4:
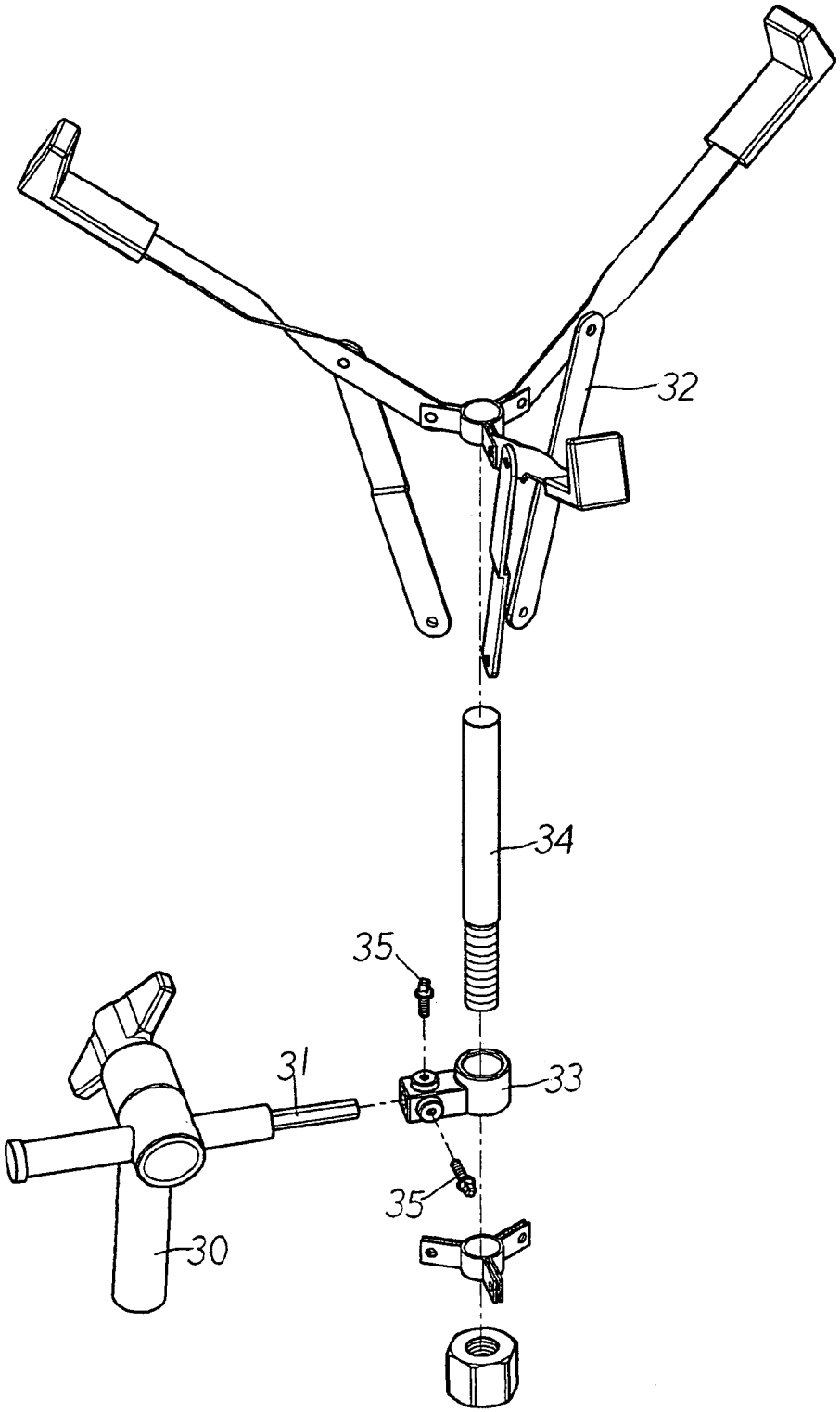
PRIOR ART FIG. 4
FIG. 4 is an exploded view of the prior art.
Figure 5:
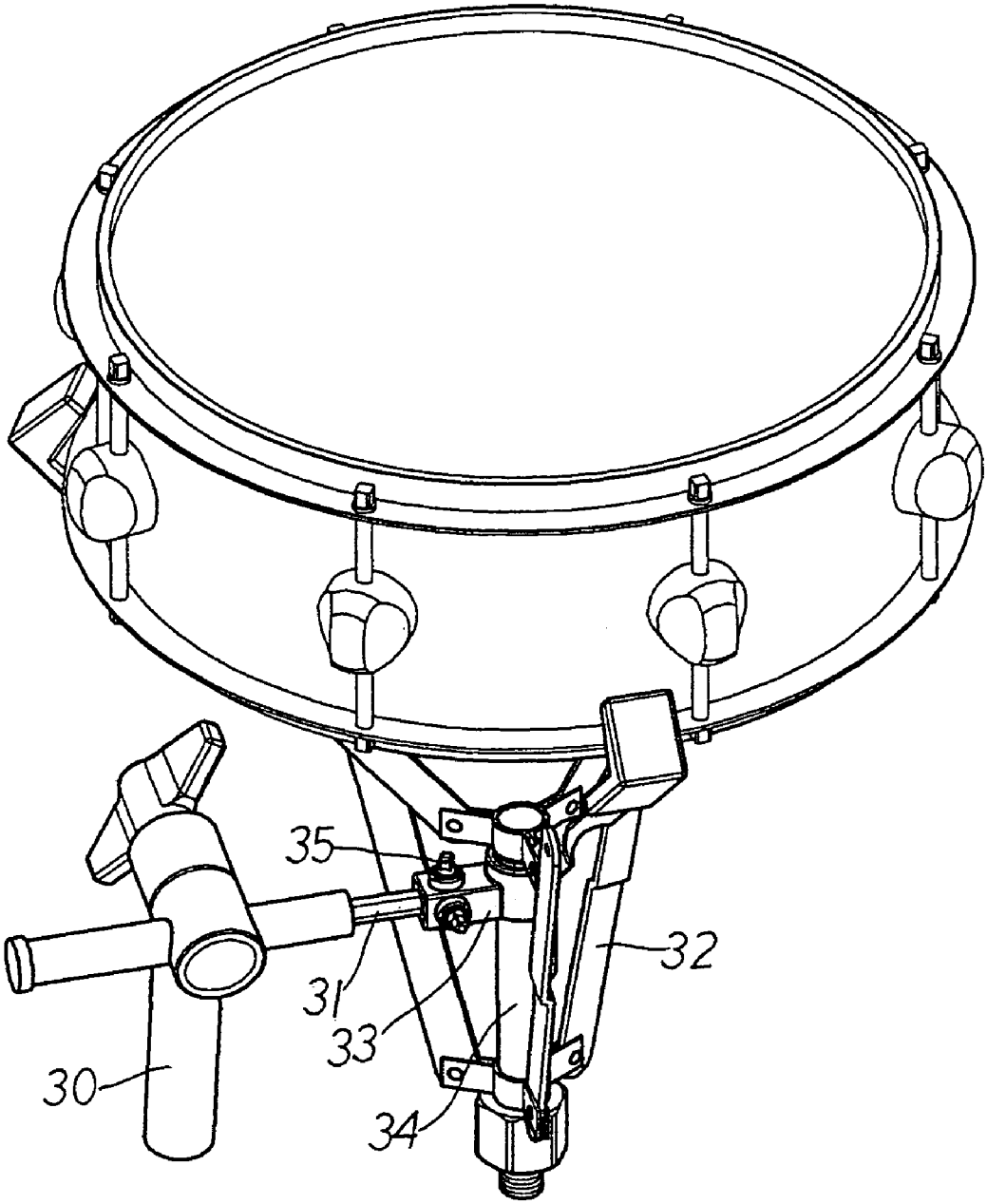
PRIOR ART FIG. 5
FIG. 5 is a schematic view showing the prior art as assembled.

Referring to FIGS. 1, 2, and 3, a lock adjustment (10) of a snare drum stand is comprised of two plates including an upper plate (11) and a lower plate (12). On one side of the lowerplate (12), a slot is provided and a corresponding ear is provided on the upper plate (11) to receive insertion of an axial pin (13) for the lock adjustment to pivot on a connector. Each plate (11, 12) is recessed at its center for both plates (11, 12) when pivoted to define a channel (14) in a form approximately similar to that of a lever (15) from the connector and in a diameter slightly smaller than that of the lever (15). The lever (15) is directly inserted into the channel (14). A screwed hole (16) is reserved on the lower plate (12) on the pivoted side and a through hole (17) is reserved on the upper plate (11) at where in relation to the screwed hole (16) for a locking bolt to directly lock up both plates from the top to fully lock up the lever (15). Accordingly, the lock adjustment (10) is secured in place to hold a snare drum in position.

In the present invention, the lock adjustment (10) is divided into an upper plate (11) and a lower plate (12) pivoted to each other on one side with an axial pin (13) so to facilitate insertion of the lever (15) from the connector. Accordingly the entire lever (15) is firmly secured in the lock adjustment (10) by means of the locking bolt (18). Whereas the locking bolt (18) is provided on one side of the lock adjustment (10) for both plates (11, 12) to tightly clamp and thus secure the lever (15). The entire lever (15) is totally free of being damaged or deformed due to one-point locking. The design of the channel (14) permits easy process and significantly lowers the nonconformity for providing an easy, safe, and practical assembly of the lock adjustment (10) for the snare drum stand.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lock adjustment of a snare drum stand comprising a connector adapted to a lever, an upper plate and a lower plate horizontally pivoted to each other on one side with an axial pin, a center inner surface of each of said upper and lower plates being recessed to define a channel when said upper and lower plates are pivoted to each other, a screwed hole being reserved on said lower plate on a pivoted side, a through hole being provided on said upper plate and positioned corresponding to said screwed hole, and a locking bolt inserted into said screwed hole and said through hole to fully lock said upper and lower plates thereby clamping said lever from said connector to firmly secure said lever in position, wherein diameter of said channel is slightly smaller than diameter of said lever from said connector.

* * * * *